US005819969A

United States Patent [19]

Kalodye

[11] Patent Number: 5,819,969

[45] Date of Patent: Oct. 13, 1998

[54] TAMPER-EVIDENCING LID ASSEMBLY

[76] Inventor: Michael Kalodye, 6 Merredin Close, Yarrawarra, New South Wales 2233, Australia

[21] Appl. No.: 780,613

[22] Filed: Jan. 8, 1997

[51] Int. Cl.[6] ..... B65D 41/48

[52] U.S. Cl. ..... 215/251; 215/277; 215/901

[58] Field of Search ..... 215/250, 251, 215/277, 278, 303, 901, 230; 220/214, 257

[56] References Cited

U.S. PATENT DOCUMENTS

| | | | |
|---|---|---|---|
| 2,124,873 | 7/1938 | Conner | 215/251 |
| 3,838,785 | 10/1974 | Lancesseur | 215/251 |
| 3,952,901 | 4/1976 | Conti | 215/251 |
| 4,433,790 | 2/1984 | Gibson | 215/251 X |
| 4,442,946 | 4/1984 | MacDonald et al. | 215/250 X |
| 4,527,701 | 7/1985 | Schaubeck | 215/251 X |
| 4,621,744 | 11/1986 | Foster | 220/214 X |
| 4,669,620 | 6/1987 | Coifman | 215/251 X |

FOREIGN PATENT DOCUMENTS

| | | | |
|---|---|---|---|
| 2328626 | 5/1977 | France | 215/251 |

*Primary Examiner*—Allan N. Shoap
*Assistant Examiner*—Nathan Newhouse
*Attorney, Agent, or Firm*—Frommer Lawrence & Haug LLP; William S. Frommer

[57] ABSTRACT

A tamper-evidencing lid assembly comprises a cap (10) adapted to be threadingly engaged upon the neck of a bottle (15). The cap has rotatably mounted thereon a shell (11) being sized and shaped to cover the cap to a sufficient extent to prevent a user from turning the cap with respect to the receptacle whilst the shell (11) is in place. The shell (11) further includes a hub (12) frangible therefrom by means of bridges (13).

In order to gain access to the cap (10) so as to rotate it, the shell is lifted and removed by breaking the bridges (13). Once the shell is removed, it is clearly evident that the assembly has been tampered with.

14 Claims, 6 Drawing Sheets

TAMPER-EVIDENCING LID ASSEMBLY

FIELD OF THE INVENTION

The following invention relates to a tamper-evidencing lid assembly. More particularly, though not exclusively, the invention relates to a tamper-evidencing lid assembly for a bottle. Known tamper-evidencing lid assemblies for medication bottles, soft drink bottles and the like comprise a frangible ring surrounding the neck of a bottle at the base of the cap. The ring may be designed to fracture in a plurality of locations or pull away from the cap upon the first attempt at removal of the cap from the bottle.

Some such known assemblies are often difficult to remove and cause some inconvenience to the consumer. Furthermore, some such known assemblies often provide little if any immediate and obvious visual warning to a consumer at the point of purchase to warn that the cap has been removed. Moreover, it might not be until a bottled product has been taken home and first opened that it becomes apparent that the lid has previously been removed.

OBJECT OF THE INVENTION

It is the object of the present invention to overcome or substantially ameliorate at least one of the above disadvantages and/or more generally to provide an improved tamper-evidencing lid assembly for a receptacle.

DISCLOSURE OF THE INVENTION

There is disclosed herein a tamper-evidencing lid assembly for a receptacle having a threaded opening, said assembly comprising:

- a cap adapted to be threadingly engaged with said opening, said cap comprising rotational engagement means, and
- a shell rotatably mounted to said cap, said shell being sized and shaped to cover said cap to a sufficient extent to prevent a user from turning said cap with respect to said receptacle whilst said shell is in place, said shell further comprising hub means frangible therefrom and by which said shell is rotatably engaged with said rotational engagement means of said cap.

Preferably, said rotational engagement means comprises a lock-on button connected by a stem to said cap.

Preferably, said lock-on button, stem and cap are an integral plastics moulding.

Preferably, said hub comprises a disc having an aperture therethrough, said aperture being sized and shaped to snap engage over said lock-on button.

Preferably, the aperture in said hub is tapered.

Preferably, said hub is integrally formed with said shell and connected therewith by a plurality of radially extending bridges.

Preferably, said radially extending bridges are adapted to fracture allowing the shell to be lifted away from the cap.

Preferably, said receptacle to which the tamper-evidencing lid assembly is adapted to be fitted is a bottle having an annular support bead at the base of said threaded opening.

There is further disclosed herein a combination of the above disclosed tamper-evidencing lid assembly and a receptacle having a threaded opening and an annular support bead at the base of said threaded opening, and wherein said shell comprises an annular skirt adapted to abut said annular support bead if squeezed by a user.

Preferably, said annular support bead has a maximum diameter greater than or equal to the maximum diameter of said cap.

Preferably, said engagement means comprises a plurality of lock-on annular ridge elements formed integrally with, though foldable with respect to said cap.

Preferably, said hub comprises an annular engagement barb adapted to cooperate with said plurality of annular ridge elements.

Preferably, said cap comprises an annular recess into which said annular barb is received and retained therein by said plurality of annular ridge elements.

There is further disclosed herein a cap adapted to be threadingly engaged with a threaded opening of a receptacle, said cap comprising rotational engagement means adapted to cooperate with a shell which might be affixed to the cap to form a tamper-evidencing lid assembly, said rotational engagement means comprising a plurality of lock-on annular ridge elements formed integrally with, though foldable with respect to said cap.

Preferably, the cap further comprises an annular recess about said rotational engagement means.

There is further disclosed herein a shell adapted to be rotatably mounted upon a cap and being sized and shaped to cover the cap to a sufficient extent to prevent a user from turning the cap with respect to a receptacle upon which the cap might be threadingly engaged, said shell further comprising hub means frangible therefrom and by which said shell can be rotatably engaged with the cap.

Preferably said hub comprises an annular engagement barb adapted to cooperate with engagement means on the cap.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

In FIGS. 1 to 7 of the accompanying drawings there is schematically depicted a cap 10 having internal thread (not shown) by which the cap 10 may be threadingly engaged upon the neck of a bottle 15. Bottle 15 typically comprises a neck having external thread to which the internal thread of the cap 10 may be threadingly engaged.

Extending upwardly from the centre of cap 10 is a stem 17 having integrally moulded thereon a lock-on button 14.

Figure 1:
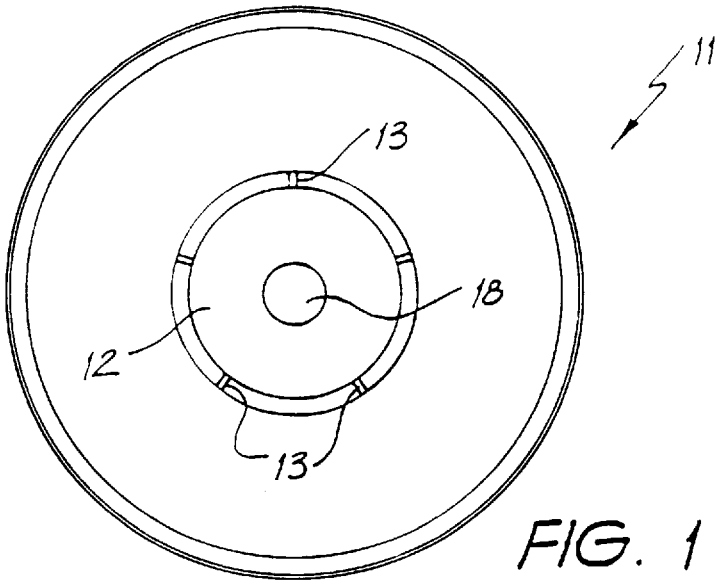
FIG. 1 is a schematic plan view of a shell.
Figure 2:
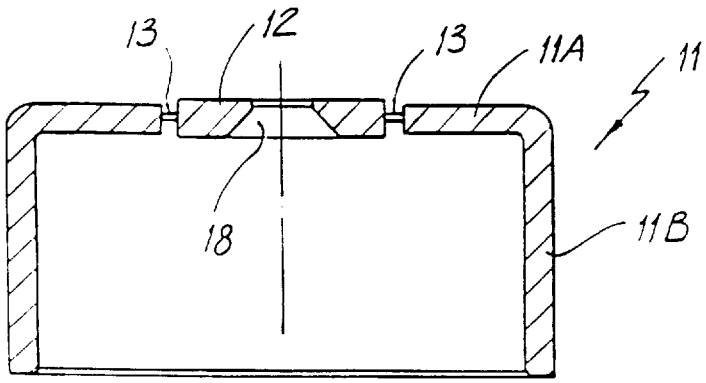
FIG. 2 is a schematic cross sectional elevational view of the shell of FIG. 1.

As shown in FIGS. 1 and 2, a shell 11 comprises an upper portion 11A and a downwardly depending annular skirt 11B. The upper portion 11A of shell 11 is connected by a plurality of shear bridges 13 to a hub 12. Moreover, hub 12, shear bridges 13 and cap portions 11A and 11B are formed as an integral moulding. Passing through the centre of hub 12 is a tapered aperture 18 by which the shell 11 may be snap engaged over the lock-on button 14 so as to allow free rotation of the shell 11 upon stem 17.

The cap 10 can comprise an annular rail 19.

Figure 4:
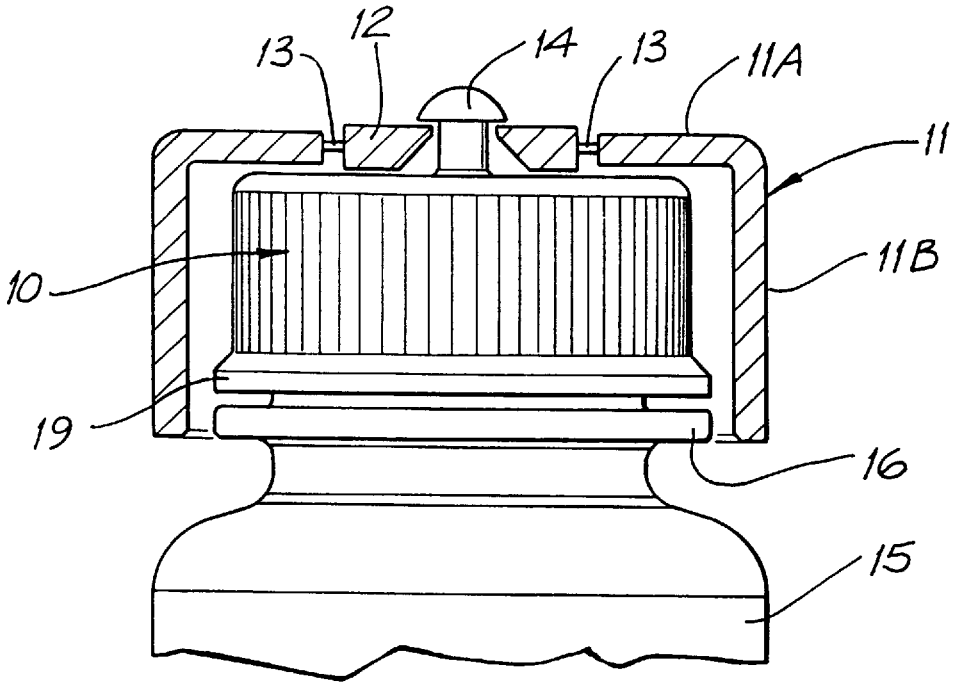
FIG. 4 is a schematic cross sectional elevational view of the shell of FIGS. 1 and 2 and the cap of FIG. 3 in position upon a receptacle.
Figure 5:
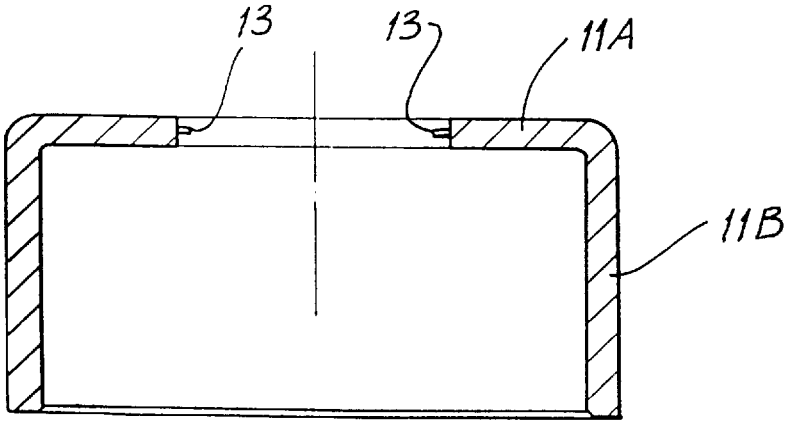
FIG. 5 is a schematic cross sectional elevational view of the part of the shell of FIGS. 1, 2 and 4 once frangibly removed from the assembly of FIG. 4.
Figure 6:
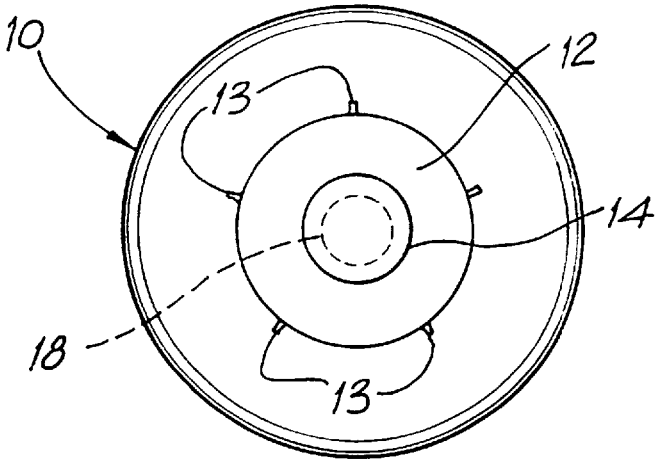
FIG. 6 is a schematic plan view of the assembly of FIG. 4 with the part of FIG. 5 removed.
Figure 7:
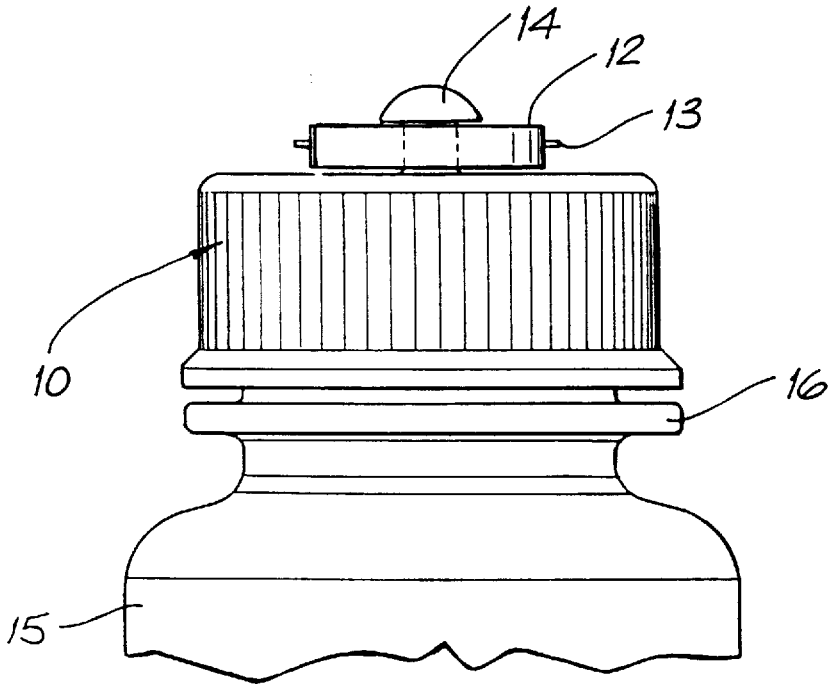
FIG. 7 is a schematic elevational view of the assembly of FIG. 4 with the part of FIG. 5 removed.

As shown if FIG. 4, the bottle 15 comprises an annular support bead 16. The support bead 16 is to have a diameter equal to or greater than the diameter of the rail 19. As an alternative, the support bead 16 need not extend out as far as the rail 19. For example, if the shell 11 and cap 10 are fabricated from a material such a polypropylene and/or other materials, possibly including slip additives, the support bead 16 may be reduced in diameter or eliminated altogether. Moreover, if the skirt 11B were compressed by a user and turned such that its inside surface were to bear against the rail 19, and if the coefficient of friction between those two surfaces was sufficiently low, the cap 10 could not be turned as the force thereon resulting from frictional engagement of the said surfaces would not exceed the force necessary to turn cap 10 upon the thread of the bottle. As a result, standard bottles 15 may be used.

In the assembled configuration as depicted in FIG. 4, the shell 11 may be freely rotated without affecting rotation of cap 10. If an attempt is made by a user to squeeze the skirt portion 11B to engage the cap 10, the lower extremity of the skirt 11B would deform and engage the annular bead 16 of the bottle 15. Such engagement would prevent further deformation and frictional engagement of skirt 11B with the rail 19 or other portions of cap 10.

In order to remove the shell 11 from the cap 10 it may be lifted upwardly so as to shear the bridges 13 to allow removal of the shell 11, thus providing access to the cap 10 which may then be removed conventionally.

Figure 3:
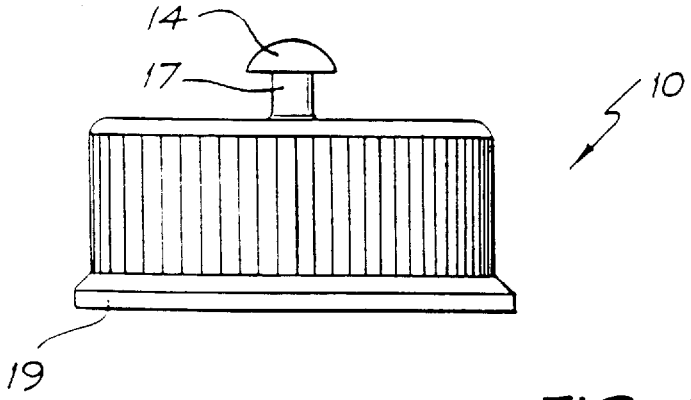
FIG. 3 is a schematic elevational view of a cap.

The assembly may be applied to a bottle as follows:

Firstly, the cap 10 as depicted in FIG. 3 can be screwed onto the bottle 15, either manually or by automated process.

Secondly, the shell 11 can be forced down over the lock-on button 14 by manual application of pressure to hub 12, or by automated process.

Should it be desired to provide an assembly comprising cap 10 and shell 11 as an assembly prior to application to a bottle 15, a series of apertures may pass through skirt portion 11B by which a special tool may pass through skirt 11B for engagement with cap 10 for the purpose of rotating the same upon a bottle as an assembly.

In FIGS. 8 to 15 of the accompanying drawings there is schematically depicted a further embodiment. In the drawings, like reference numerals correspond with those of like parts in FIGS. 1 to 7.

Figure 8:
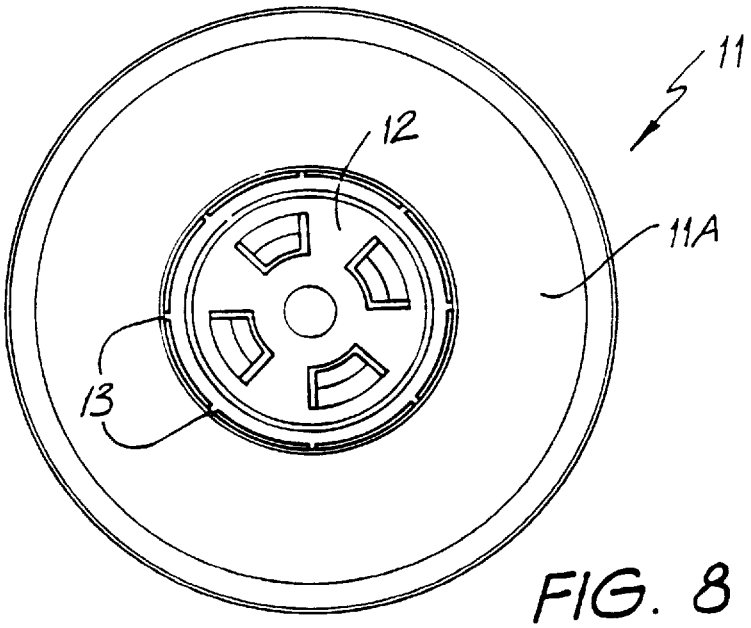
FIG. 8 is a schematic plan view of another shell.
Figure 9:
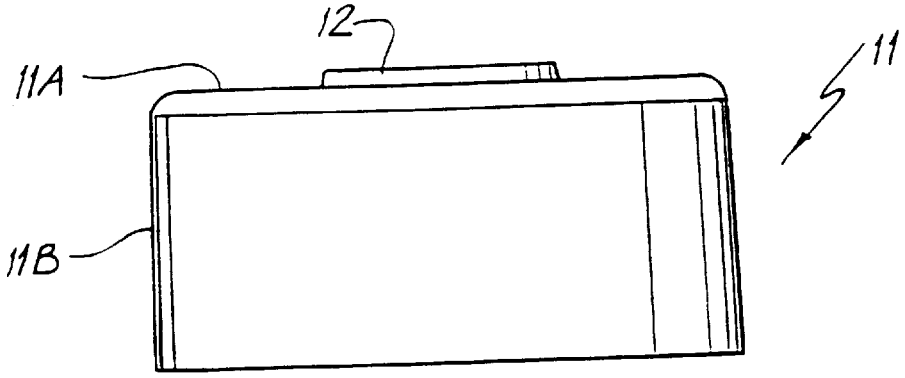
FIG. 9 is a schematic elevational view of the shell of FIG. 8.
Figure 10:
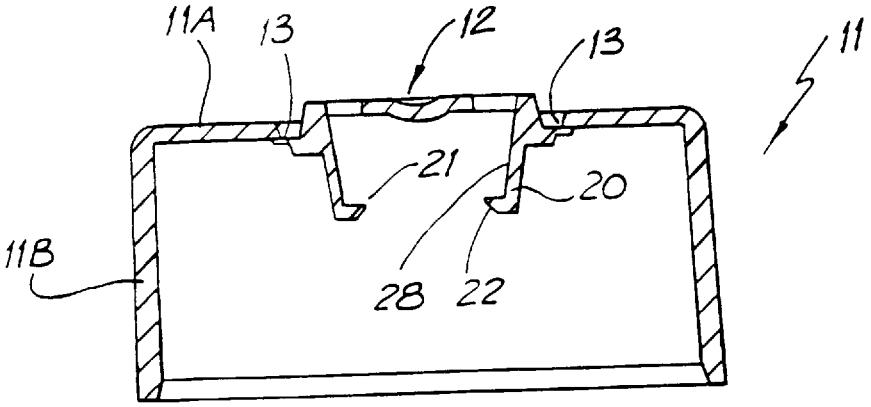
FIG. 10 is a schematic cross-sectional elevational view of the shell of FIGS. 8 and 9.

The shell as depicted in FIGS. 8 to 10 comprises an upper portion 11A and a downwardly depending annular skirt 11B. At the centre of the upper portion 11A, there is integrally moulded a hub 12 having downwardly depending therefrom an engagement annulus 20. At the bottom of engagement annulus 20 there is provided an annular engagement barb 21 having an annular tapered surface 22 as shown in FIG. 10.

Figure 11:
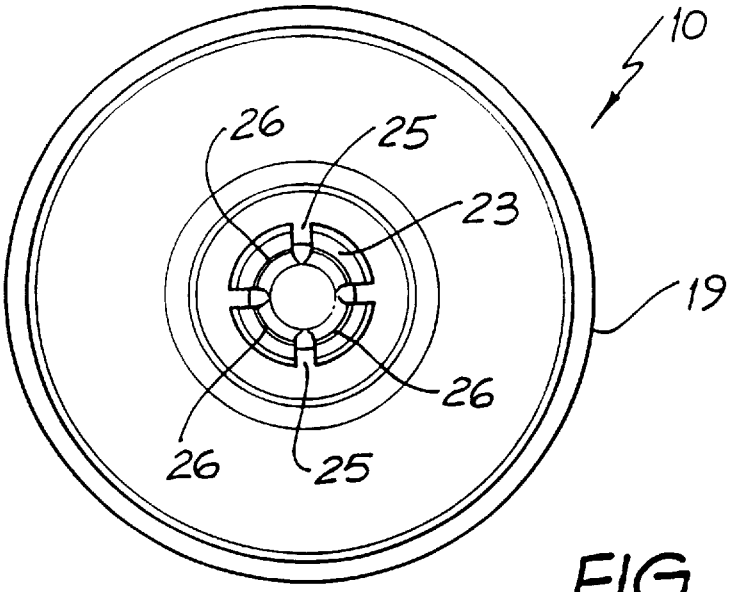
FIG. 11 is a schematic plan view of a cap having an annular lock-on ridge extending upwardly in an as-moulded configuration.
Figure 12:
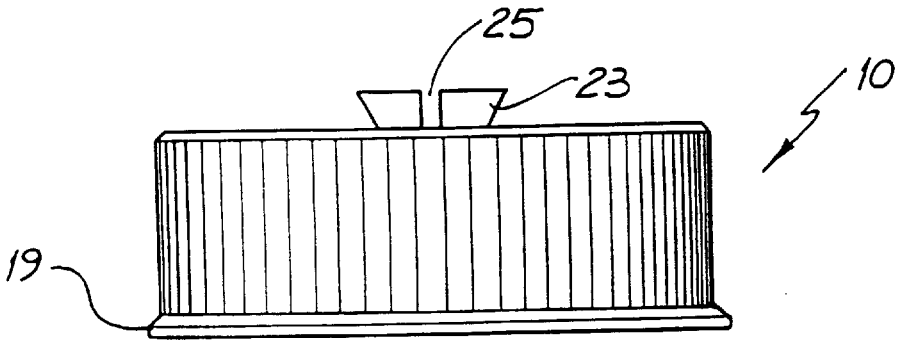
FIG. 12 is a schematic elevational view of the cap of FIG. 11.
Figure 13:
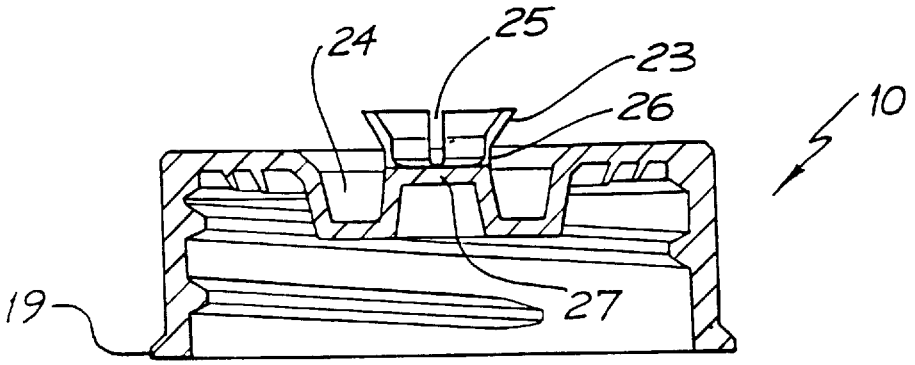
FIG. 13 is a schematic cross-sectional elevational view of the cap of FIGS. 11 and 12.

In FIGS. 11 to 13 there is depicted a cap 10 adapted to engage with the shell 11 of FIGS. 8 to 10. Cap 10 has formed into its upper surface an annular recess 24. This recess surrounds a circular landing 27 having extending substantially upwardly therefrom a series of four lock-on annular ridge elements 23. Each lock-on annular ridge element 23 is integrally formed with the cap 10 and extends from the periphery of the circular landing 27 by means of a series of weakened or thinned fold lines 26. Each lock-on annular ridge element 23 is spaced from its neighbouring ridge element by means of a gap 25.

Having the lock-on annular ridge elements 23 extend substantially upwardly as shown in FIGS. 11 to 13 facilitates the process of moulding the cap 10. However, it should be appreciated that the lock-on annular ridge elements 23 are adapted to fold along fold lines 26 into the configuration depicted in FIG. 14.

In this configuration, the resilience of the plastics from which the cap 10 is moulded allows the lock-on annular ridge elements 23 to bend inwardly toward the landing 27 to facilitate engagement of the shell 11 therewith. During this process, the shell 11 is pushed downwardly such that the tapered surface 22 of the annular engagement barb 21 inwardly deflects each lock-on annular ridge element 23 as the engagement annulus 20 is received by the annular recess 24. Once barb 21 passes each ridge element 23, the element 23, under the resilience of the plastics material in the hinge portions 26 moves outwardly to the position indicated in FIG. 14 so as to prevent removal of the hub 12 whilst allowing rotation thereof with respect to the cap 10.

Figure 14:
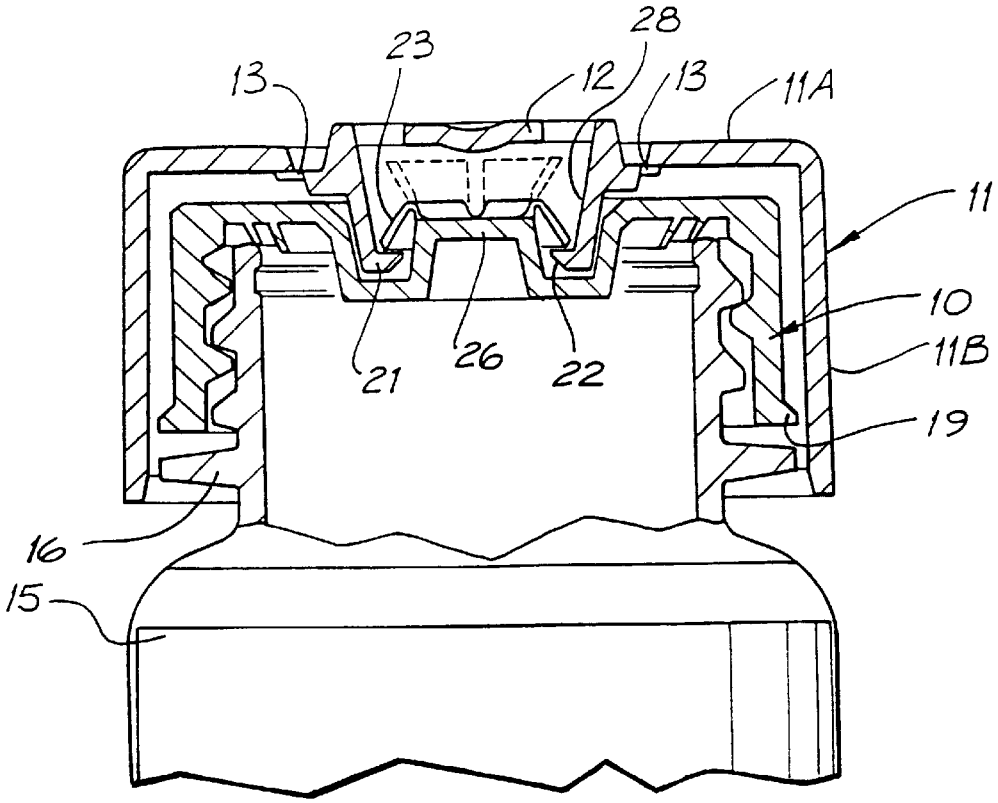
FIG. 14 is a schematic cross-sectional elevational view of the shell of FIGS. 8, 9 and 10 in position upon and engaged with the cap of FIGS. 11, 12 and 13, though with the lock-on annular ridge folded downwardly into the in-use configuration, the cap being positioned upon a bottle.
Figure 15:
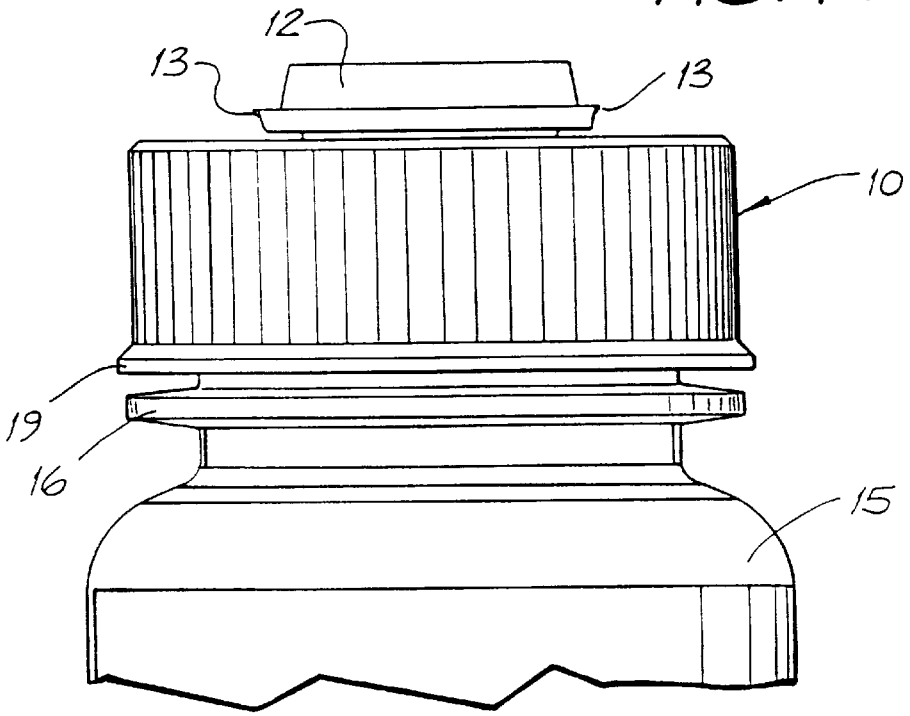
FIG. 15 is a schematic elevational view of the combination of shell, cap and bottle as illustrated in FIG. 14.

Operation of the assembly of FIG. 14 is the same in principal as that of the configured embodiment of FIG. 4. That is, in the assembled configuration of FIG. 14, the shell 11 can be freely rotated without affecting rotation of cap 10. If an attempt is made by a user to squeeze the skirt portion 11B to engage the cap 10, the lower extremity of the skirt 11B would deform to engage the annular bead 16 of the bottle 15. Such engagement would prevent further deformation and frictional engagement of skirt 11B with the rail 19 or other portions of cap 10. As an alternative, the support bead 16 need not extend out as far as the rail 19. For example, if the shell 11 and cap 10 are fabricated from a material such a polypropylene and/or other materials, possibly including slip additives, the support bead 16 may be reduced in diameter or eliminated altogether. Moreover, if the skirt 11B were compressed by a user and turned such that its inside surface were to bear against the rail 19, and if the coefficient of friction between those two surfaces was sufficiently low, the cap 10 could not be turned as the force thereon resulting from frictional engagement of the said surfaces would not exceed the force necessary to turn cap 10 upon the thread of the bottle. As a result, standard bottles 15 may be used.

In order to remove the shell 11 from cap 10, it may be lifted upwardly so as to shear bridges 13 which are located on the under surface of shell 11 to allow removal of the shell 11, thus providing access to cap 10 which may then be removed conventionally.

Upward force applied to shell 11 does not cause upward deflection of the lock-on annular ridge elements 23 to the position depicted in phantom in FIG. 14 or as shown in FIG. 12 since the tips of those elements would abut against the internal wall surface 28 of the hub 12.

It should be appreciated that modifications and alterations obvious to those skilled in the art are not to be considered as beyond the scope of the present invention. For example, cap 10 may be provided with external thread for engagement with internal thread within the neck of a bottle.

I claim:

1. A tamper-evidencing lid assembly for a receptacle having a threaded opening, said assembly comprising:

a cap to be threadedly engaged with said opening, said cap comprising rotational engagement means, a hub rotatable engaged with said rotational engagement means, a shell being sized and shaped to cover said cap to a sufficient extent to prevent a user from turning said cap with respect to said receptacle while said shell is in place and a plurality of frangible radial bridges connecting the hub to the shell, wherein said hub is rotatable on said rotational engagement means such that said shell can freely rotate around the entire circumference of the cap, said radial frangible bridges remaining intact during rotation of said shell about said entire circumference.

2. The assembly of claim 1, wherein said rotational engagement means comprises a lock-on button connected by a stem to said hub.

3. The assembly of cap 2, wherein said lock-on button, stem, hub and cap are formed of an integral plastics moulding.

4. The assembly of claim 1 wherein said hub comprises a disc having an aperture therethrough, said aperture being sized and shaped to snap engage over said lock-on button.

5. The assembly of claim 4 wherein the aperture in said hub is tapered.

6. The assembly of claim 1 wherein said radially extending bridges are adapted to fracture allowing the shell to be lifted away from the cap.

7. A combination of the assembly of claim 1 and a receptacle having a threaded opening and an annular support bead at the base of said threaded opening, and wherein said shell comprises an annular skirt adapted to abut said annular support bead if squeezed by a user.

8. The combination of claim 7 wherein said annular support bead has a maximum diameter greater than or equal to the maximum diameter of said cap.

9. The assembly of claim 1 wherein said engagement means comprises a plurality of annular ridge elements formed integrally with, though foldable with respect to said cap.

10. The assembly of claim 9 wherein said hub comprises an annular engagement barb adapted to cooperate with said plurality of annular ridge elements.

11. The assembly of claim 10 wherein said cap comprises an annular recess into which said annular barb is received and retained therein by said plurality of annular ridge elements.

12. The assembly of claim 1 wherein the cap includes a plurality of lock-on annular foldable ridge elements.

13. The assembly of claim 12 wherein said cap includes an annular recess into which said annular ridges can be folded.

14. The assembly of claim 13 wherein the hub includes an annular engagement barb which extends into the recess to rotatably engage the hub with the annular ridge elements, the barb acting to deflect the ridge elements into the recess during assembly.

* * * * *

UNITED STATES PATENT AND TRADEMARK OFFICE

CERTIFICATE OF CORRECTION

PATENT NO. : 5,819,969

DATED : October 13, 1998

INVENTOR(S) : Kalodye

It is certified that error appears in the above-identified patent and that said Letters Patent is hereby corrected as shown below:

Claim 1, line 5 (column 5, line 16), change "rotatable" to --rotatably--.

Signed and Sealed this

Fifteenth Day of June, 1999

*Attest:*

Q. TODD DICKINSON

*Attesting Officer*

*Acting Commissioner of Patents and Trademarks*